US005106321A

United States Patent [19]

Haroutel

[11] Patent Number: 5,106,321

[45] Date of Patent: Apr. 21, 1992

[54] POSTAGE METER HAVING A REMOVABLE FRANKING HEAD

[75] Inventor: Jean-Claude Haroutel, Orsay, France

[73] Assignee: Alcatel Satman, Bagneux, France

[21] Appl. No.: 624,371

[22] Filed: Dec. 7, 1990

[30] Foreign Application Priority Data

Dec. 8, 1989 [FR] France ..... 89 16250

[51] Int. Cl.[5] ..... H01R 13/62

[52] U.S. Cl. ..... 439/310

[58] Field of Search ..... 439/157, 160, 296, 310, 439/342, 343, 347, 368, 372

[56] References Cited

U.S. PATENT DOCUMENTS 3,529,276 9/1970 Hennessey, Jr. ..... 439/310
3,629,791 12/1971 Normann ..... 439/310
4,083,619 4/1978 McCormick et al. ..... 439/310
4,722,697 2/1988 Naruse et al. ..... 439/310

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

A postage meter has a removable franking head and a stationary base on which said head is mounted at a defined location, with locking means coupled to an external control for locking the head in place on the base. The meter also has two complementary connector portions for electrically interconnecting the head and the base by one of said connector portions plugging into the other. One of said first and second connector portions is movably mounted to move between an unplugged first position and a plugged second position in which the connector portions are plugged together, and is connected to actuator means for ensuring that the connector portion is in said unplugged first position while said head is being installed on the base.

7 Claims, 2 Drawing Sheets

POSTAGE METER HAVING A REMOVABLE FRANKING HEAD

The present invention relates to a postage meter or "franking machine" having a removable franking head.

BACKGROUND OF THE INVENTION

In postage meters, the franking head essentially comprises a rotary print head having print elements that are adjustable to different franking values, and metering means for monetary values, and in particular for the franked postal charges. In relatively large postage meters, the franking head constitutes a portable module which is removably mounted on a stationary base of the machine. Such machines use a conveyor to carry items of mail to be franked to the franking head. The conveyor itself is fed from a storage magazine for such items and fitted with an unstacker, or else is coupled to an automatic mail processing installation for putting mail into envelopes.

The conveyor is carried by the stationary base, with the franking head being mounted on the base at the end of the conveyor. Drive means are housed inside the stationary base and are coupled to the conveyor and to the franking head to drive them appropriately at the desired rate.

By making it possible to remove the franking head, it is possible, where necessary, to transport the franking head on its own. This is done, in particular, for operations relating to the monetary values recorded in the metering means, with such operations taking place off the premises of the user.

In order to ensure that the removable franking head is correctly mounted, the head and its stationary base are fitted with complementary means for positioning the head on the base. Manually controlled locking means are associated therewith. They enable the head to be locked in position for normal operation of the machine and for the head to be unlocked for removal purposes.

These complementary means for positioning the head on the base are constituted, for example, by a set of fingers projecting beneath the said head and by a corresponding set of holes in a platform of the base, at the end of the conveyor. These fingers projecting from the head act as legs for the head to stand on when it is removed from the base. There are therefore at least three fingers. The associated locking means are then constituted, for example, by a mechanism mounted inside the base beneath the platform and coupled to the external manual control, with grooves being provided in the fingers for engaging this mechanism. When the mechanism is engaged in the grooves, then the fingers are locked and cannot be withdrawn from the holes. In contrast, when the mechanism is disengaged from the grooves, the fingers are released and may be withdrawn from the holes in the platform.

In addition, such a postage meter having a removable franking head is provided with two complementary connector portions: one on the head and the other on the base, thereby enabling electrical signals to be interchanged between the head and the base when the connector portions are interconnected. In current machines, these connector portions plug into each other when the head is put into position on the base. The connector portions are often damaged by a head being incorrectly presented to the base. There is thus a risk of damaging the connector portions whenever the head is presented at an angle relative to the base, even though such an angle may make it easier to insert the positioning fingers into their holes in the platform of the base. Once the connector portions are damaged they need to be replaced and this has the consequence of making the postage meter unavailable for use in the meanwhile.

The object of the present invention is to reduce these risks.

SUMMARY OF THE INVENTION

The present invention provides a postage meter having a removable franking head and a stationary base on which said head is mounted, the postage meter comprising on the head and on the base respectively: firstly positioning means for positioning the head on the base for ensuring that the head is installed at a defined location on said base; and secondly two complementary connector portions for electrically interconnecting the head and the base by one of said connector portions plugging into the other; the postage meter further including locking means coupled to an external control for locking the head in place on the base, and for unlocking it, wherein one of said first and second connector portions is movably mounted to move between an unplugged first position and a plugged second position in which the connector portions are plugged together, and is connected to actuator means for ensuring that the connector portion is in said unplugged first position while said head is being installed on the base.

BRIEF DESCRIPTION OF THE DRAWINGS

An embodiment of the invention is described by way of example with reference to the accompanying drawings, in which.

DETAILED DESCRIPTION

Figure 1:
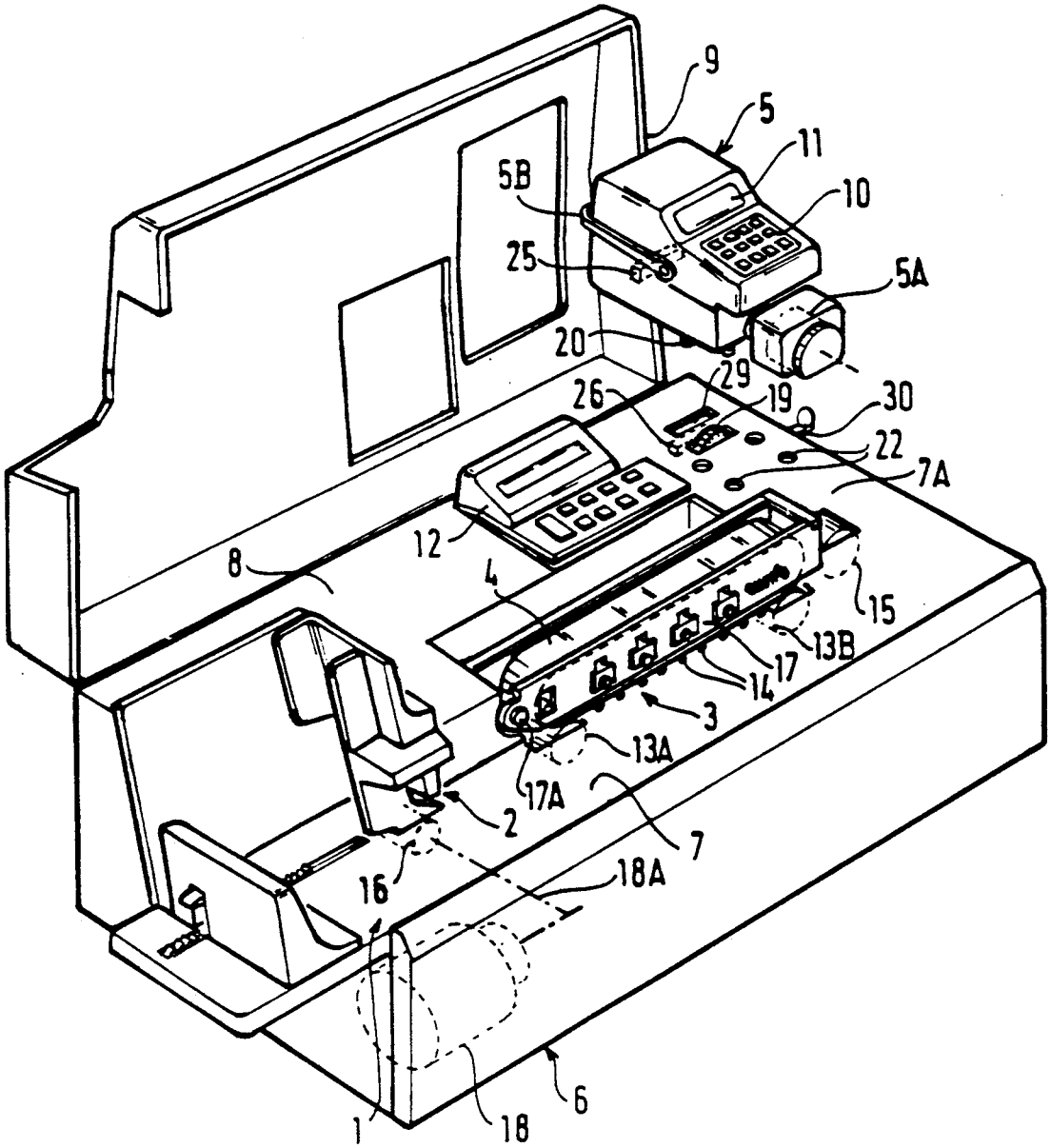
FIG. 1 is a diagrammatic perspective view of a postage meter having a removable franking head in accordance with the present invention, with the franking head being shown removed from its position on the base of the machine.

The general organization of a postage meter with a removable franking head as shown in FIG. 1 is known per se. Its overall description is given briefly. The machine comprises:

- a storage magazine 1 for receiving a stack of letters to be franked;
- an unstacking assembly 2 mounted on the front face of the storage magazine 1 for which it constitutes an unstacker, for the purpose of delivering the letters separately, one-by-one;
- a conveyor 3 having an endless belt 4 for receiving letters from the magazine fitted with its unstacker;
- a franking head 5 having a rotary print drum 5A and receiving letters to be franked directly from the conveyor; and
- a stationary base 6 carrying the magazine 1 fitted with its unstacker and conveyor 3, and on which the franking head 5 constitutes a module which is mounted removably.

The franking head is shown in a non-mounted position relative to the base 6 which has a location for receiving it at the end of the conveyor. A handle 5B is provided on the head 5.

The base 6 has a horizontal top platform 7 and a rear side portion 8 standing proud of the platform. The platform defines a plane on which letters advance along the conveyor beneath the head 5 when installed on the base. A cover 9 closes the machine and has windows suitable for a keypad 10 and a display screen 11 mounted on the head and for a control assembly 12 of the machine and also having an associated keypad and screen.

Rollers 13A and 13B and small intermediate rollers 14 referred to as "pins" are mounted inside the base facing the conveyor belt 4 and together with the belt 4, they define the conveyor 3. A backing roller 15 for the print drum 5A in the head and at least one roller 16 for the magazine fitted with its unstacker are also provided inside the base.

These rollers lie flush with the top face of the platform. The pins 14 and the rollers 13A and 13B are stationary while the conveyor belt is urged resiliently towards them, with the conveyor belt 4 being resiliently mounted on a support 17 hinged about an end axis 17A at its end opposite from the head 5. The backing roller 15 has resilient play inside the base.

Drive means are mounted inside the base 6. They are given an overall reference 18. They comprise a common motor for the machine as a whole plus a clutch for the franking head. They are coupled to the rollers 13A, 13B, and 16, to the conveyor belt 4, and to the head 5, as represented by a single transmission 18A extending to one of the above-mentioned rollers. With respect to the transmission for the conveyor belt, it is merely specified that the transmission is connected to a driving pulley carrying the belt and disposed close to the axis 17A, and that the transmission link is flexible or includes a universal joint. The transmission with the franking head is connected to a driving gear wheel 19 which projects slightly above the platform 7 and which meshes with another gear wheel on the shaft of the print drum. When the machine is in operation, the conveyor 3 is driven continuously while the above-mentioned clutch is used to ensure that the print drum 5A is rotated through a single turn only for each franking cycle. The clutch and the triggering of a franking cycle for each of the letters are under the control of means for detecting successive letters as they arrive in the vicinity of the head.

In FIG. 1, the location provided on the platform 7 at the end of the conveyor 3 for receiving the franking head 5 is designated 7A. In addition to the backing roller 15 and the driving gear wheel 19 for the franking head, the location 7A and the head 5 are also equipped with means suitable for ensuring that the head is accurately positioned at the end of the conveyor 3 and for locking it in position, together with means for connecting the head electrically with the base.

Figure 2:
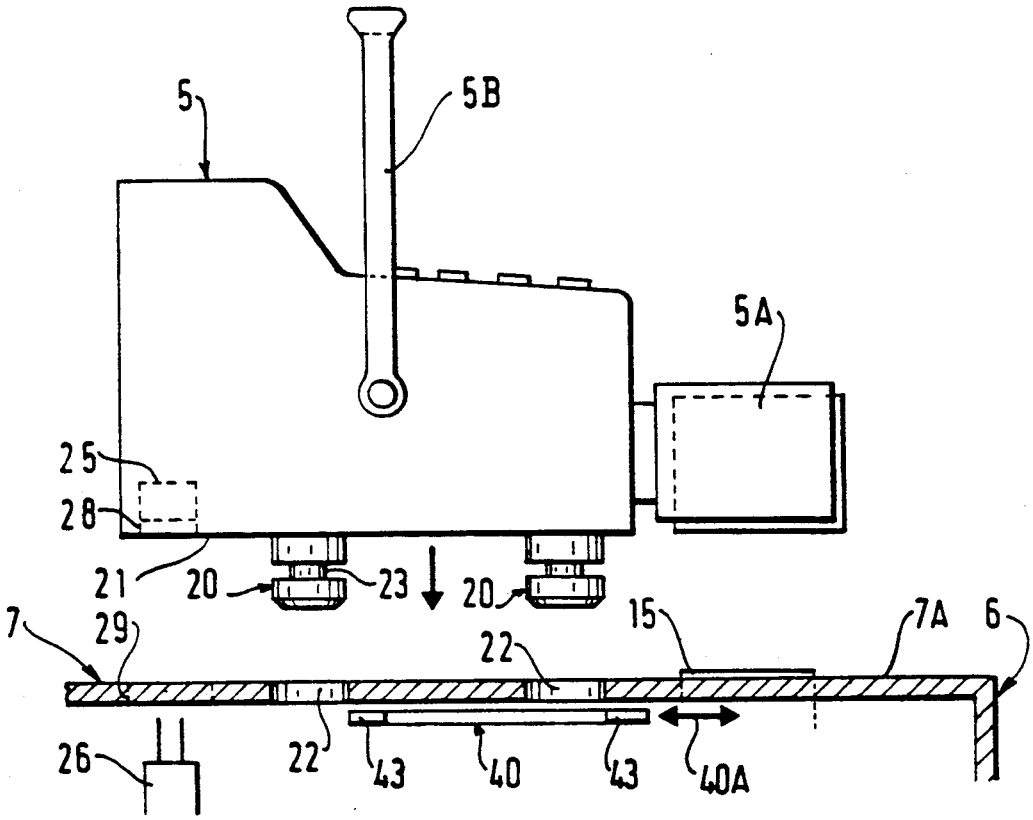
FIG. 2 is a diagrammatic elevation view showing the equipment on the franking head and on the base as shown in FIG. 1 for the purposes of mounting the head on the base and of interconnecting the head and the base.
Figure 3:
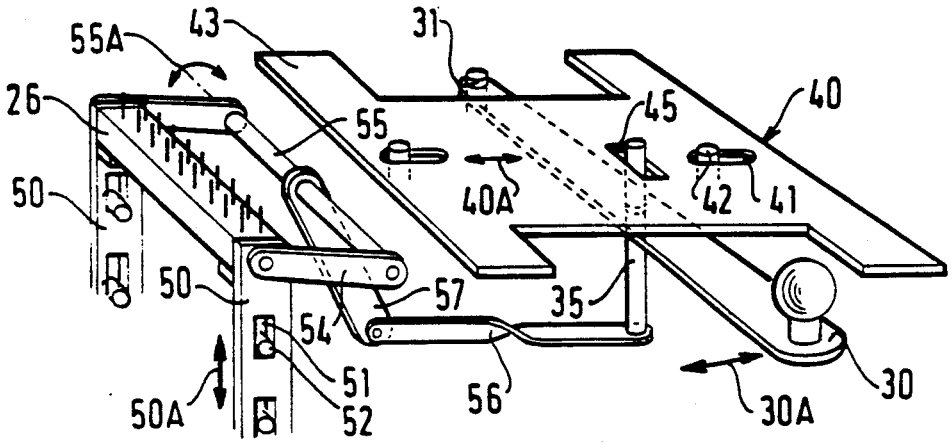
FIG. 3 is a diagrammatic perspective view of a mechanism for locking the head on the base while simultaneously making electrical connections therebetween.

These means on the base and on the head are described with reference to FIG. 1, and more particularly with reference to FIGS. 2 and 3.

The head has four fingers 20 projecting from its bottom, which fingers serve as legs for the head when it is removed from the base 6, and they serve as elements for positioning and locking the head on the location 7A. The location 7A has four holes 22 disposed in correspondence to receive the fingers which are inserted therein. There four fingers have respective circular grooves 23 substantially halfway therealong, which grooves are disposed immediately below the platform 7 when the fingers are in the holes 22.

The head 5 is also fitted with a first connector portion 25 which corresponds to a second connector portion 26 in the base, for interconnecting the base and the head electrically.

Connector portion 25 is disposed on one side of the set of fingers 20 along the bottom rear edge of the head when the head is installed on the base 6. This connector portion is disposed in a retracted position above the bottom 21 of the head in a housing 28 which opens out through the bottom and which is provided to receive the connector portion, thereby protecting it when the head is removed from the base.

The second connector portion 26 is disposed in comparable manner relative to the four holes 22 so as to face the first connector portion 25 when the head is in place on the base. This connector portion 26 is retractable into the base 6 through a window 29 provided in location 7A on the platform 7. It is mounted to slide vertically inside the base and can therefore be put into a position where it is retracted beneath the platform, referred to as the "unplugged" position, thereby enabling the head to be installed without plugging the connector portions 25 and 26 together, or in a raised position referred to as the "plugged" position, in which the connector portions are plugged together and the head is thus connected to the base. This is performed only once the head has been put into position.

The connector portion 26 is raised to its plugged position simultaneously with the head 5 being locked on the base 6. Conversely, it is retracted into its unplugged position simultaneously with the head being unlocked from the base. This simultaneous control of locking and of electrical connection between the head and the base or of unlocking and electrical disconnection between the head and the base is controlled by a lever 30 which is hinged at one end about a vertical axis 31 inside the base and which is accessible at its other end outside the machine (FIG. 1). The lever 30 is actuated about its axis 31 in the directions shown by arrow 30A. It is coupled both to a locking plate 40 and to a support 50 carrying the connector portion 26.

The locking plate 40 is mounted beneath location 7A and it is movable horizontally beneath the platform 7 in the directions double-headed arrow 40A. It has horizontal slots 41 parallel to arrow 40A and it is supported by vertical stationary pins or fingers 42 on the base. The travel provided for the pins 42 in the slots 41 enable the plate to be displaced. The plate 40 has four tabs 43 for engaging the four fingers 20. These tabs are engaged in the grooves 23 in the fingers 20 of the head or else they are disengaged therefrom, depending on the direction in which the lever 30 is actuated.

The plate 40 is coupled to the lever by a vertical coupling pin or rod 35. The pin 35 is fixed to the lever by passing substantially through the middle thereof and it is received in a slot 45 of the plate, which slot extends transversely relative to the slots 41.

The support 50 for the connector portion 26 is mounted to slide vertically inside the base as shown by arrow 50A. It is constituted by a pair of vertical arms designated by the same reference 50, with the connector portion 26 being mounted between the ends thereof. These arms 50 have vertical slots 51 having horizontal stationary pins or fingers 52 of the base engaged therethrough. The amount of vertical displacement possible for the connector portion is determined by the length of the windows 51.

These vertical arms 50 carry a pair of control links 54 which are hinged at one end to the arms and which have their opposite ends interconnected by a control shaft or rod 55 to which they are fixed. The control shaft 55 is itself coupled to the rod 35 fixed on the lever 30 so as to be rotated in the directions of arrow 55A when the lever 30 is actuated. The rod 35 is coupled to the shaft 55 via a connecting rod 56 and a crank 57. One end of the crank is hinged to one of the connecting rod. The other end of the connecting rod 56 is fixed to the bottom end of the rod 35, and the connecting rod is twisted or deformed substantially halfway along so as to change its plane by 90°. The other end of the crank 57 is fixed to the shaft 55 which it drives.

By combining the control for raising the connector portion 26 on the base with the control for locking the head 5 on the base 6, all risk of damaging the connector portions 25 and 26 while the head is being installed on the base is avoided. This combined control is easily provided. In addition it makes the head easier to install since there is no longer any requirement for it to be presented parallel to the platform.

Naturally, although it is preferable for the retractable portion to be the connector portion mounted in the base, given that it is operated simultaneously with head locking by a mechanism contained in the base, it would be possible in a variant for the connector portion in the head to be the moving portion while the connector portion in the base remains stationary. For example, under such conditions, the locking plate could actuate a moving part of the head which serves in turn to displace the connector portion inside the head. This moving part of the head could be constituted, in particular, by one of the fingers projecting beneath the head and mounted so as to be movable through the bottom of the head, which finger would then not have a groove.

Naturally, the embodiment shown in the drawings has been given purely by way of example and other equivalent embodiments could be adopted without thereby going beyond the scope of the present invention.

I claim:

1. A postage meter comprising:

a removable franking head and a stationary base on which said head is mounted, first positioning means on said head and second positioning means on said base for positioning the head on the base for ensuring that the head is installed at a defined location on said base; first and second complementary connector portions respectively mounted on said head and said base for electrically interconnecting the head and the base by one of said connector portions plugging into the other; locking means coupled to an external control for locking the head in place on the base, and for unlocking said head, means for mounting one of said first and second connector portions to move between an unplugged first position and a plugged second position in which the connector portions are plugged together, and said actuator means being operativably connected to said external control for ensuring that said one connector portion is in said unplugged first position while said head is being installed on the base.

2. A postage meter according to claim 1, wherein said actuator means comprises coupling means for placing said moving connector portion into said plugged second position while locking the head, and into said unplugged first position while unlocking said head.

3. A postage meter as claimed in claim 1, wherein said base comprises a horizontal platform, said first positioning means comprises a plurality of spaced fingers projecting from a bottom of the head, wherein said platform includes holes disposed at locations corresponding to the fingers of said head, and sized to receive the fingers inserted therein and constituting said second positioning means.

4. A postage meter according to claim 3, wherein said fingers include circular grooves about the periphery of the fingers at locations such that the grooves are disposed immediately below the platform, when said head is mounted on said base, and wherein said locking means further comprises a locking plate mounted beneath the platform for movement towards and away from the fingers, and wherein the plate has a plurality of tabs engaging respective fingers for locking the head to the base.

5. A postage meter according to claim 2, in which said locking means are mounted inside the base where said locking means are coupled to said external control, and wherein the moving connection portion is the connector portion of said base, and said base also includes said actuator means and said coupling means for coupling said actuator means to said external control.

6. A postage meter according to claim 5, wherein the coupling means comprise coupling links which are hinged to one another and connected firstly to a rod controlled by said external control and secondly to a control shaft belonging, together with at least one associated control link, to said actuator means for the moving connector portion, said moving connector portion being carried by a support mounted to move vertically inside said base and controlled to move vertically by said actuator means, and, when in said unplugged first position, retracting beneath a top horizontal platform of said base on which the location for said head is defined.

7. A postage meter according to claim 5, wherein said external control comprises a lever, mounted for pivoting about an axis perpendicular to the plane of the locking plate, and operatively coupled to said locking plate for shifting said tabs between circular groove engagement and circular groove disengagement position, wherein said moving connector portion is fixed at opposite ends to vertical arms mounted for movement towards and away from said platform and at right angles to the movement of said locking plate and wherein, said actuator means comprises a crank mechanism, operatively connected at one end to said vertical arms, and at opposite ends to said pivotable lever such that, pivoting of said lever between said first and second positions causes said moving connector portion to automatically move into the plug, second position while locking the head and into the unplug, first position while unlocking said head.

* * * * *